US011542139B2

(12) United States Patent
Calcott et al.

(10) Patent No.: US 11,542,139 B2
(45) Date of Patent: Jan. 3, 2023

(54) KEG FILLING APPARATUS

(71) Applicant: Nichesolutions (GB) Limited, Northampton (GB)

(72) Inventors: Paul Calcott, Northampton (GB); Paul Burchell, Northampton (GB); Aaron Brown, Northampton (GB)

(73) Assignee: Nichesolutions (GB) Limited

( * ) Notice: Subject to any disclaimer, the term of this patent is extended or adjusted under 35 U.S.C. 154(b) by 90 days.

(21) Appl. No.: 16/972,033

(22) PCT Filed: May 31, 2019

(86) PCT No.: PCT/GB2019/000078
§ 371 (c)(1),
(2) Date: Dec. 4, 2020

(87) PCT Pub. No.: WO2019/234378
PCT Pub. Date: Dec. 12, 2019

(65) Prior Publication Data

US 2022/0162050 A1 May 26, 2022

(30) Foreign Application Priority Data

Jun. 6, 2018 (EP) ..... 18000501

(51) Int. Cl.
*B67C 3/30* (2006.01)
*B67C 3/24* (2006.01)
*B67C 3/34* (2006.01)

(52) U.S. Cl.
CPC ..... *B67C 3/30* (2013.01); *B67C 3/24* (2013.01); *B67C 3/34* (2013.01)

(58) Field of Classification Search
CPC ..... B67C 3/24; B67C 3/30; B67C 3/34
See application file for complete search history.

(56) References Cited

U.S. PATENT DOCUMENTS 1,115,223 A 10/1914 Marriott et al.
2,564,163 A * 8/1951 Leperre ..... C12N 1/22 141/2

(Continued)

FOREIGN PATENT DOCUMENTS

BE 902644 9/1985
DE 19838549 3/2000

(Continued)

OTHER PUBLICATIONS

International Search Report dated Sep. 24, 2019 issued in International Application No. PCT/GB2019/000078 (3 pages).

(Continued)

*Primary Examiner* — Nicolas A Arnett
(74) *Attorney, Agent, or Firm* — Merek, Blackmon & Voorhees, LLC

(57) ABSTRACT

A keg filling apparatus (101) is disclosed. The apparatus (101) comprises a stand (102) and a keg receiving plate (201). The stand (102) comprises a plurality of legs (105) and braces (107) for supporting an upper bracket (106) at a convenient height. The keg receiving plate (201) is releasably attached to the upper bracket (106) of the stand (102) and comprises a coupler (204). The coupler (204) releasably engages a keg valve to allow the keg to be filled through the valve. The apparatus further comprises alternative keg receiving plates (208 & 210), these plates comprising alternative couplers (209 & 211) for releasable engagement with different valves. The apparatus obviates present issues in stability during the filling of one-way kegs which must be inverted during the filling process.

14 Claims, 6 Drawing Sheets

(56) References Cited

U.S. PATENT DOCUMENTS

| | | | | | |
|---|---|---|---|---|---|
| 3,563,287 | A * | 2/1971 | Ruddick | B67C 3/34 | 141/270 |
| 3,827,466 | A * | 8/1974 | Wiggin | B67C 7/00 | 141/369 |
| 3,831,645 | A * | 8/1974 | Golding | B67C 3/34 | 414/771 |
| 4,685,598 | A * | 8/1987 | Nezworski | B67D 1/0832 | 222/400.7 |
| 5,649,575 | A * | 7/1997 | Till | B65B 55/02 | 141/90 |
| 6,196,277 | B1 * | 3/2001 | Till | B67C 3/32 | 141/10 |
| 6,230,763 | B1 * | 5/2001 | Till | B67C 3/32 | 141/100 |
| 9,475,102 | B2 * | 10/2016 | de Amblia | B08B 9/0826 | |

FOREIGN PATENT DOCUMENTS

| | | | | |
|---|---|---|---|---|
| DE | 20303217 | | 6/2003 | |
| DE | 20303517 | | 9/2003 | |
| EP | 0363768 | B1 * | 3/1993 | B67C 7/00 |
| GB | 1115223 | | 5/1968 | |
| WO | WO-2020007515 | A1 * | 1/2020 | B67C 3/32 |

OTHER PUBLICATIONS

European Search Report dated Dec. 5, 2019 issued in connection with European Application No. 18000501.9 (2 pages).

Extended European Search Report and Written Opinion dated Dec. 12, 2019 issued in connection with European Application No. 18000501.9 (5 pages).

* cited by examiner

KEG FILLING APPARATUS

BACKGROUND OF THE INVENTION

1. Field of the Invention

The present invention relates to the field of equipment for supporting kegs during the filling process. More particularly, it relates to securely supporting one-way kegs of varying valve design in an inverted position during the filling process with liquids such as, but not limited to, ales.

2. Description of the Related Art

One-way kegs are an increasingly popular design of keg for use within the brewing industry. In particular, one-way kegs serve an ever-increasing demographic of micro-brewers who utilise such kegs due to their particularly favourable properties which include recyclability, cost efficiency and imparted product longevity. However, the primary concern and draw back in relation to the use of one-way kegs is the lack of stable means for filling said kegs with the intended product.

The lack of stability during filling of such one-way kegs stems from the need to invert said keg during the filling process. Inversion is necessary due to the valve system and design for gravity fed filling. One-way kegs that are known in the art are not of a design which allows them to be safely balanced about their top surface. In this regard, it is commonplace at present for users of such a keg to invert said keg and balance it on a level raised platform, such as a crate, and proceed to fill said keg in an unstable and unsecured position. Therefore, this is currently a dangerous process given that the keg can topple off of the surface with ease and when filled to capacity, may weigh ≈30 kg, thus forming a significant health risk and inconvenience.

It has therefore been known for some time within the field that there is a need for a means with which an individual can safely secure a keg in an inverted position prior to filling of said keg. However, at present, this demand has not been met.

Accordingly, it is an object of the present invention to provide a stand for securely fastening a keg in an inverted position, facilitating controlled and safe filling of said keg with the user's liquid of choice. Said stand must further address the requirement to support and communicate with keg valves of varying design with minimum disruption to the filling process.

BRIEF SUMMARY OF THE INVENTION

According to a first aspect of the present invention, there is provided a keg filling apparatus, said keg filling apparatus comprising: a stand means, comprising a top surface; characterised in that said stand means is provided with a first detachable member, wherein said first detachable member is configured to be releasably attached to said top surface and comprises a first coupling means for releasable engagement with a keg valve.

Preferably, said keg filling apparatus further comprises a second detachable member, said second detachable member comprising a second coupling means, wherein said second detachable member is interchangeable with the first detachable member and configured to be releasably attached to the top surface of said stand means.

Most preferably, said keg filling apparatus also comprises a third detachable member, said third detachable member comprising a third coupling means, wherein said third detachable member is interchangeable with the first and second detachable members and configured to be releasably attached to the top surface of said stand means.

Preferably, said top surface of said stand means comprises a plurality of top surface apertures capable of receiving attachment members for releasable attachment to any one of the first, second or third detachable member, thus facilitating selective mounting of any one of the first, second or third coupling means for selective compatibility with different keg valves.

Preferably, the first, second and third detachable members each comprise a plurality of detachable member apertures adapted to receive said attachment members for releasable attachment to the top surface of said stand means by way of said plurality of top surface apertures.

Preferably, said attachment members of the keg filling apparatus comprise threaded bolts or screws and an internal circumference of each said top surface aperture and each said detachable member aperture is helically threaded so as to receive said threaded bolts or screws and thus releasably attach the first, second or third detachable member to the top surface of said stand means.

Preferably, each of the first, second and third coupling means comprises an upper portion and a lower portion, and are fixedly attached adjacent said upper portion to the respective first, second and third detachable member and extends through said detachable member by way of a coupling aperture, such that said lower portion projects substantially below the plane of said detachable member.

Preferably, said stand means comprises a coupler receiving recess, dimensioned and configured to receive the lower portion of any one of the first, second or third coupler means when the corresponding first, second or third detachable member is releasably attached to said stand means through the top surface.

Preferably, said stand means comprises at least two stand members, said stand members comprising elongate rigid structures, each fixedly connected at a first end to opposing sides of the top bracket of said stand means.

Preferably, said stand members extend generally vertically and symmetrically from said stand means with a second end remote from the first and adapted so as to sit flush with a level surface, thus supporting the top surface of said stand means parallel to said level surface.

More preferably, said stand means further comprises at least two lateral support members, said lateral support members comprising substantially rigid elongate structures with first and second remote ends.

Most preferably, said lateral support members extend between the stand members and are fixedly attached adjacent their first and second ends to said stand members at a point in between the first and second ends of said stand members;

Preferably said keg filling apparatus further comprises a suspended support panel, said suspended support panel comprising a substantially rigid structure with an inner face and a connective margin.

Preferably, said stand means further comprises a side surface that is substantially transverse to the top surface, where said side surface is attached to the suspended support panel by its connective margin so as to orientate the inner face of said suspended support panel toward an inner volume of the apparatus.

Preferably, said pump means is fixedly connected to said inner face of the suspended support panel, said pump means is in fluid connection with a produce inlet means and the lower portion of either the first, second or third coupling means by way of first and second pipe members respectively.

Preferably, said keg filling apparatus further comprises a base support plate, wherein said base support plate comprises a substantially rigid structure, is fixedly connected between the first and second lateral support means and is dimensioned to non-fixedly receive said pump means.

BRIEF DESCRIPTION OF THE DRAWINGS

The invention will now be described by way of example only with reference to the accompanying drawings, which are purely schematic and not to scale, of which.

DETAILED DESCRIPTION OF EXAMPLE EMBODIMENTS

FIG. 1

Figure 1:
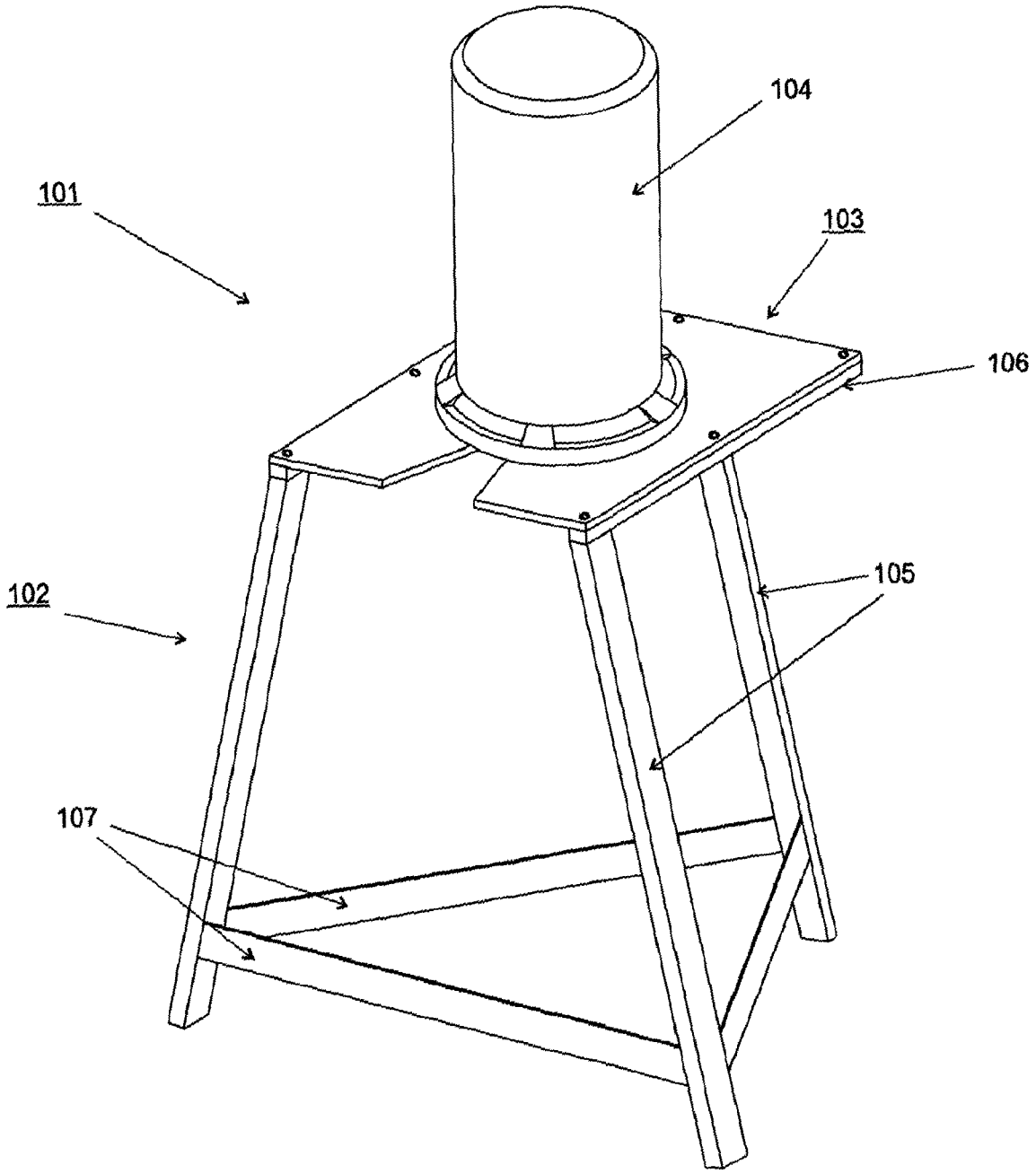
FIG. 1 is a schematic illustration of the present invention in use in a perspective view.

An example of the present invention in use is illustrated in FIG. 1. A keg filling apparatus (indicated generally at 101), comprises a stand (indicated generally by 102) and a top plate (indicated generally at 103), wherein the top plate 103 is adapted to receive a vessel 104 for filling, according to a specific embodiment of the present invention. Said top plate 103 is dimensioned and designed to receive the uppermost surface of said vessel 104.

In the example, the stand 102 is a stand of substantially conventional form, comprising a plurality of elongate stand members 105, said stand members being fixedly connected adjacent their first ends to a top bracket 106. Said stand members 105 extend generally vertically and symmetrically away from to the top bracket 106 with their second ends adapted so as to sit flush with a level ground surface. Accordingly, said top bracket 106 is suspended above the level ground surface and runs parallel to said ground surface, providing a top surface (indicated later in FIG. 2*b*). Said stand members 105 comprise elongate rigid structures which are capable of supporting an appreciable load with respect to the intended purpose of the apparatus.

The stand 102 further comprises a plurality of lateral support members 107. Said lateral support members 107 comprise substantially rigid elongate structures with first and second ends. Said lateral support members 107 each extend between respective pairs of the plurality of stand members 105 and are fixedly attached adjacent their first and second ends to said respective stand members 105. Said lateral support members 107 are situated at a point in between the first and second ends of said stand members 105. In this example, said lateral support members 107 are situated closer to the second ends of said stand members 105, thus supporting the lower third of the apparatus 101 and further preventing the stand members 105 from splaying further outward upon bearing a significant load.

It shall be appreciated that although the specific embodiment of the invention described herein utilises three stand members 105 and accordingly represents a tripod of sorts, alternative equivalent embodiments comprising two or four stand members may be used. The present embodiment is utilised over a single stand member, whose construction might comprise significantly a cantilevered structure, so as to provide a stand with improved stability, especially on somewhat uneven surfaces. This latter point is of particular importance when the apparatus is used in a field, such as at a festival. In this regard, the present apparatus not only provides a means for filling one-way kegs, but also a means for supporting said kegs in use for gradual distribution of its contents to consumers. It shall also be appreciated that although the specific embodiment of the invention described herein features stand members 105 and lateral support members 107 that are fixedly connected to the top bracket 106 and each other respectively, in an alternative embodiment said stand members 105, lateral support members 107 and top bracket 106 may be releasably attached. That is to say, in an alternative embodiment, the principal components of the stand 102 shall be releasably attached, by way of bolts and hinges, so as to provide an apparatus 101 of the present invention that is also collapsible.

FIGS. 2*a*, 2*b*, 2*c*, 2*d* and 2*e*

Figure 2A:
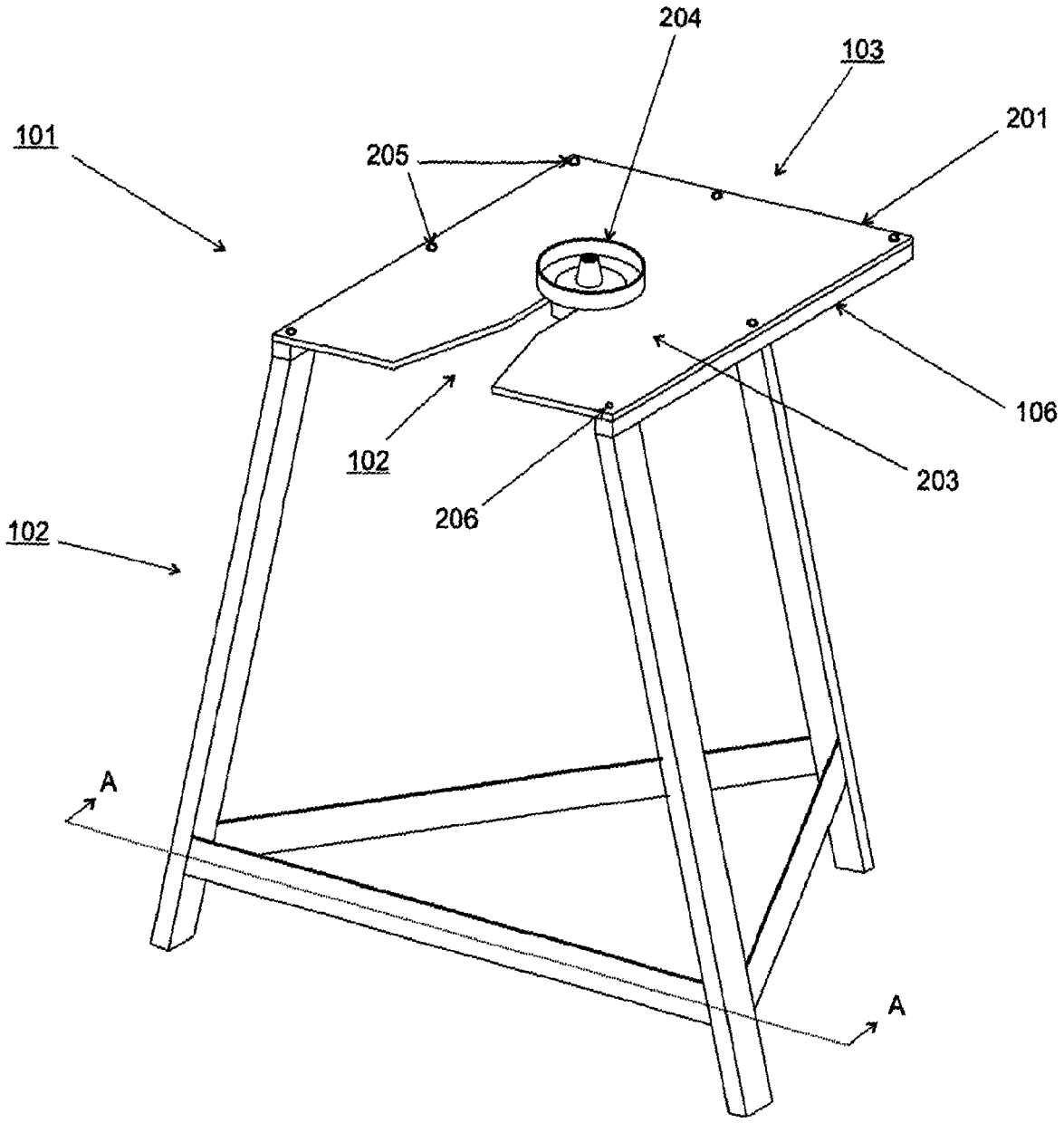
FIG. 2*a* shows the keg filling apparatus previously identified in FIG. 1 in isolation in a perspective view.
Figure 2B:
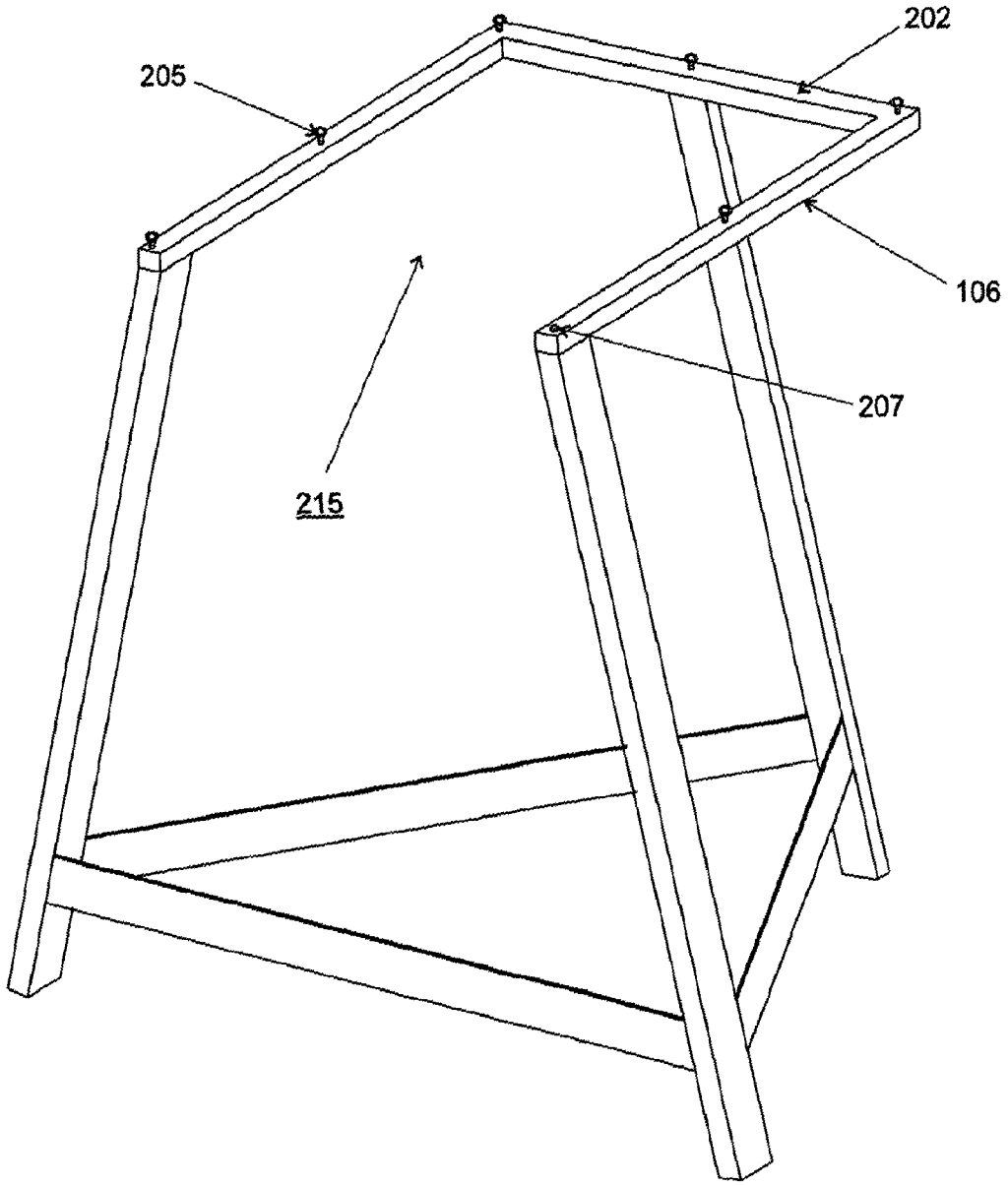
FIG. 2*b* shows the keg filling apparatus previously identified in FIG. 2 in isolation in a perspective view with the top plate removed.
Figure 2C:
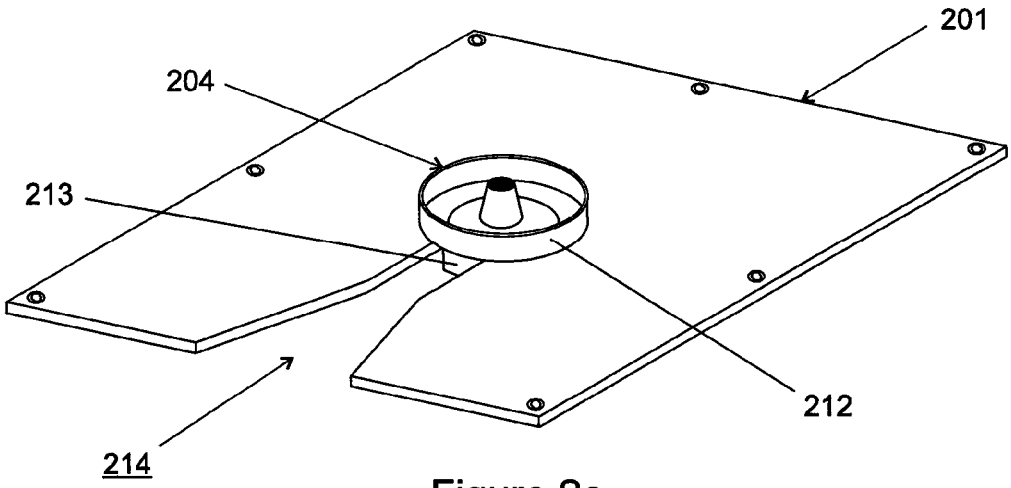
FIG. 2*c* shows the first detachable member of the keg filling apparatus in a perspective view.
Figure 2D:
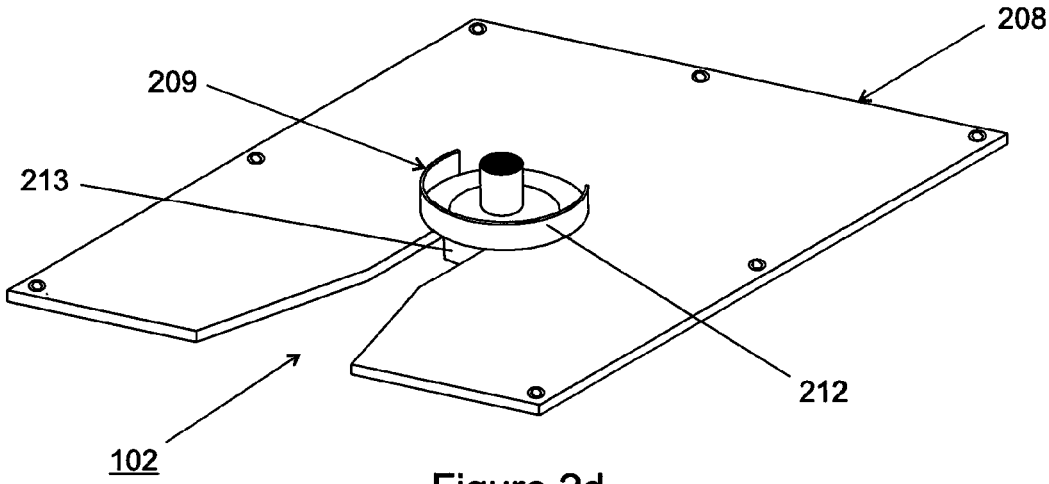
FIG. 2*d* shows the second detachable member of the keg filling apparatus in a perspective view.
Figure 2E:
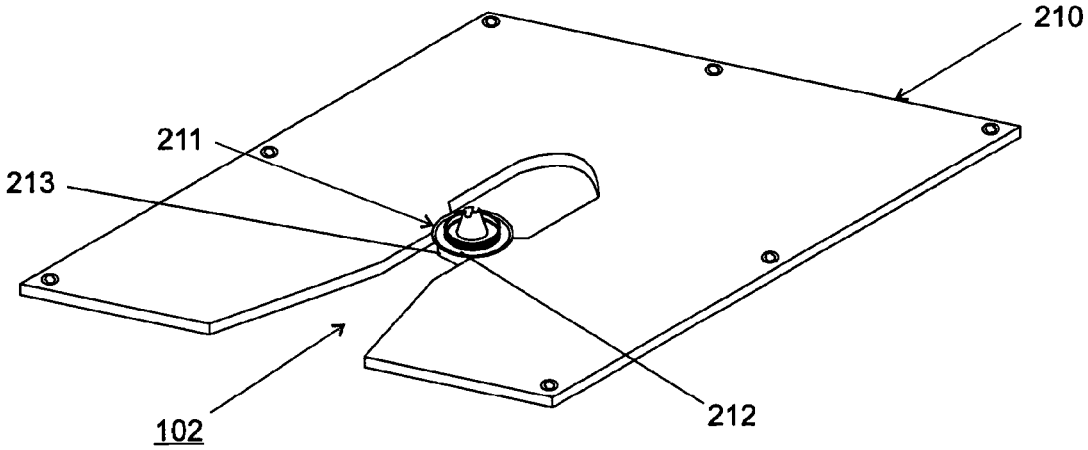
FIG. 2*e* shows the third detachable member of the keg filling apparatus in a perspective view.

The keg filling apparatus 101 previously identified in FIG. 1 is shown in a perspective view in FIG. 2*a* with omission of the vessel 104 and again in FIG. 2*b* with further omission of the top plate 103. FIGS. 2*c* to 2*e* represent example embodiments of different top plates to be discussed herein.

Referring to the figures, the keg filling apparatus 101 is provided with a top plate 103. Said top plate 103 comprises a first detachable member 201 that is releasably attached to a top surface 202 of the top bracket 106. Said first detachable member 201 comprises a substantially planar upper surface 203 that is dimensioned to receive the uppermost surface of an inverted one-way keg and thus provides a means to support said keg in an upright position.

Said first detachable member 201 comprises a first coupling means 204 that is designed for releasable engagement with a first valve design. Said first coupling means 204 comprises a first specific design of coupler. The function of a coupler within the present field is to releasably engage with a valve of a corresponding design, providing a fluid communication therethrough. Accordingly, when the user of the apparatus 101 wishes to prepare a vessel 104 for filling, the user first rests said vessel 104 about the planar upper surface 203 of the first detachable member 201, taking care to align the valve of said vessel 104 with the first coupling means 204. The user then rotates the vessel 104 so as to engage its valve with the first coupling means 204, thus mechanically engaging the two features and facilitating fluid communication therethrough. Accordingly, the vessel 104 is therefore in a primed position, ready for filling, which will be discussed further with regards to FIGS. 3*a* and 3*b*.

Said first detachable member 201 is releasably attached to the top surface 202 of the top bracket 106 by way of attachment members 205. Said attachment members 205 comprise threaded bolts or screws and are received through a plurality of detachable member apertures (indicated at 206, where the apparatus 101 is depicted as having a single attachment member 205 removed, thus presenting said aperture 206 for review). Said detachable member apertures 206 are adapted to receive said attachment members 205 therethrough and thus be releasably attached to the top surface 202 of the top bracket 106. In this regard, the top surface 202 of the top bracket 106 comprises a plurality of top surface apertures 207. Said top surface apertures 207 are adapted to receive said attachment members 205 therethrough, thus facilitating releasable attachment of said first detachable member 201 to the top surface 202 of said top bracket 106. On account of the attachment members 205 comprising threaded bolts or screws, the internal circumference of the detachable member apertures 206 and top surface apertures 207 are helically threaded, thus facilitating mechanical engagement.

The apparatus 101 may also be provided with a second detachable member 208. Said second detachable member 208 comprises a second coupling means 209 and is interchangeable with the first detachable member 201. That is to say, the second detachable member 208 is substantially similar in design to that of the first detachable member 201 with exception of the second 209 and first 204 coupling means respectively. Accordingly, the second detachable member 208 is also releasably attached to the top surface 202 of the top bracket 106 by way of attachment members 205 through detachable member apertures 206.

Said second coupling means 209 of said second detachable member 208 is designed for releasable engagement with a second valve design. Said second coupling means 209 comprises a second specific design of coupler. Therefore, the user of the apparatus 101 may remove the first detachable member 201 by removal of the attachment members 205 and replace said first detachable member 201 with said second detachable member 208, attaching said second detachable member to the top surface 202 of the top bracket 106 by way of said attachment members 205. In doing so, the user of the apparatus 101 may select the design of coupler (first 204 or second 209) embodied by the apparatus 101 and therefore may selectively couple the apparatus 101 to vessels 104 of varying valve design.

The apparatus 101 may further be provided with a third detachable member 210. Said third detachable member 210 comprises a third coupling means 211 and is interchangeable with the first 201 and second 208 detachable members. That is to say, the third detachable member 210 is substantially similar in design to that of the first 201 and second 208 detachable members with exception of the third coupling means 211. Accordingly, the third detachable member 210 is also releasably attached to the top surface 202 of the top bracket 106 by way of attachment members 205 through detachable member apertures 206.

Said third coupling means 211 of said third detachable member 210 is designed for releasable engagement with a third valve design. Said third coupling means 211 comprises a third specific design of coupler. Therefore, the user of the apparatus 101 may remove the first 201 or second 208 detachable member by removal of the attachment members 205 and replace said first 201 or second 208 detachable member with said third detachable member 210, attaching said third detachable member 210 to the top surface 202 of the top bracket 106 by way of said attachment members 205. In doing so, the user of the apparatus 101 may select the design of coupler (first 204, second 209 or third 211) embodied by the apparatus 101 and therefore may selectively couple the apparatus 101 to vessels 104 of varying valve design.

The first 204, second 209 and third 211 coupling means of the apparatus 101 each comprise an upper portion 212 and a lower portion 213. Each of the first 201, second 208 and third 210 detachable members comprise a coupling aperture 214. Said coupling aperture (indicated generally at 214) is situated substantially centrally within the first 201, second 208 and third 210 detachable members and extends openly to a given side of each respective detachable member. Said coupling aperture 214 therefore forms a recess capable of receiving the first 204, second 209 and third 211 coupling means therethrough.

Each of the first 204, second 209 and third 211 coupling means are fixedly attached adjacent their upper portion 212 to the first 201, second 208 and third 210 detachable members respectively. Accordingly, the lower portion 213 of each of the first 204, second 209 and third 211 coupling means extends through the coupling aperture 214 of the respective first 201, second 208 and third 210 detachable members and is presented below the plane of said detachable members. The top bracket 106 of the apparatus 101 is also dimensioned so as to present a coupler receiving recess (indicated generally at 215).

It shall be understood that the top bracket 106 of the present apparatus 101 is configured so as to present a large recess in this regard, thus enabling utilisation of any reasonably dimensioned coupler. More specifically, the coupler receiving recess 215 is dimensioned to receive the lower portion 213 of any of the first 204, second 209 and third 211 coupling means, whilst providing sufficient clearance so as to obviate the risk of damaging said couplers in the process of changing the interchangeable first 201, second 208 and third 210 detachable members. In doing so, the present invention is more readily adaptable to incorporation of alternative couplers and couplers of future design.

It shall be appreciated that although the specific embodiment of the invention described herein utilises three interchangeable detachable members, comprising first 204, second 209 and third 211 coupling means respectively, the present apparatus 101 may be provided with further interchangeable detachable members, comprising further alternative coupling means. In doing so, the present apparatus 101 may be provided with a means to comprise any one of a number of commercially used couplers for any one of a number of commercially used valves. Such valves include but are not limited to A-type, S-type, G-type, D-type and U-type.

Figure 3A:
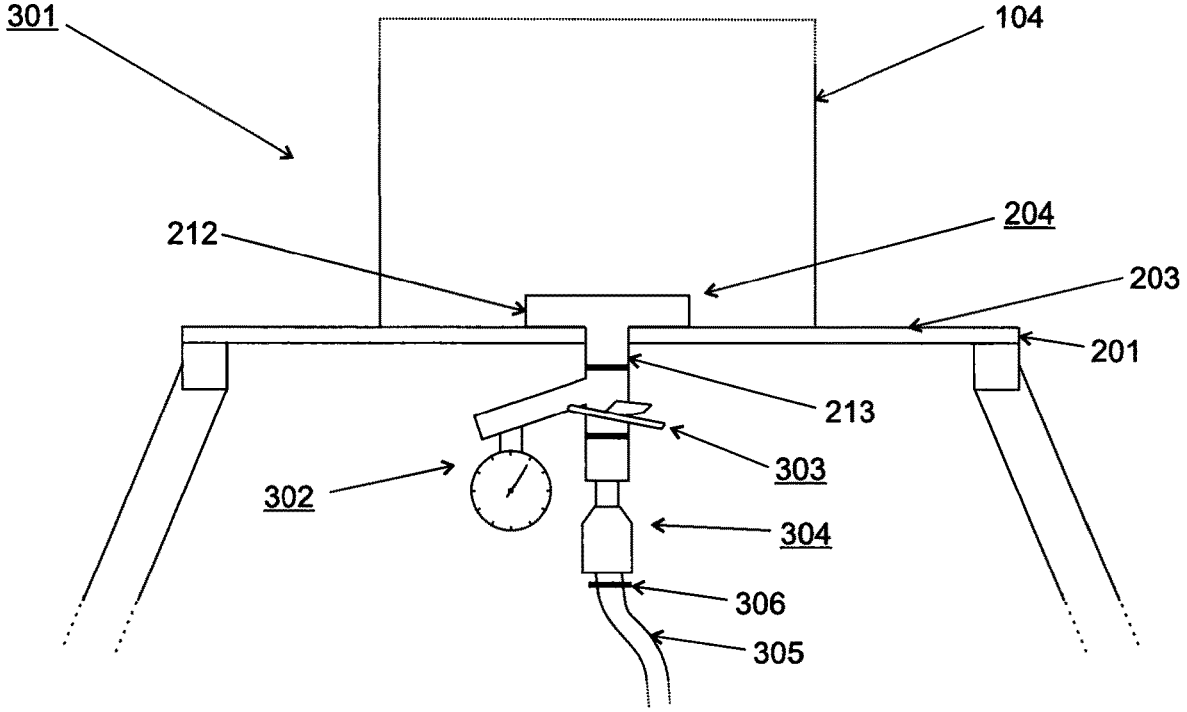
FIG. 3*a* is a semi-transparent front elevation of a first embodiment of the keg filling apparatus.
Figure 3B:
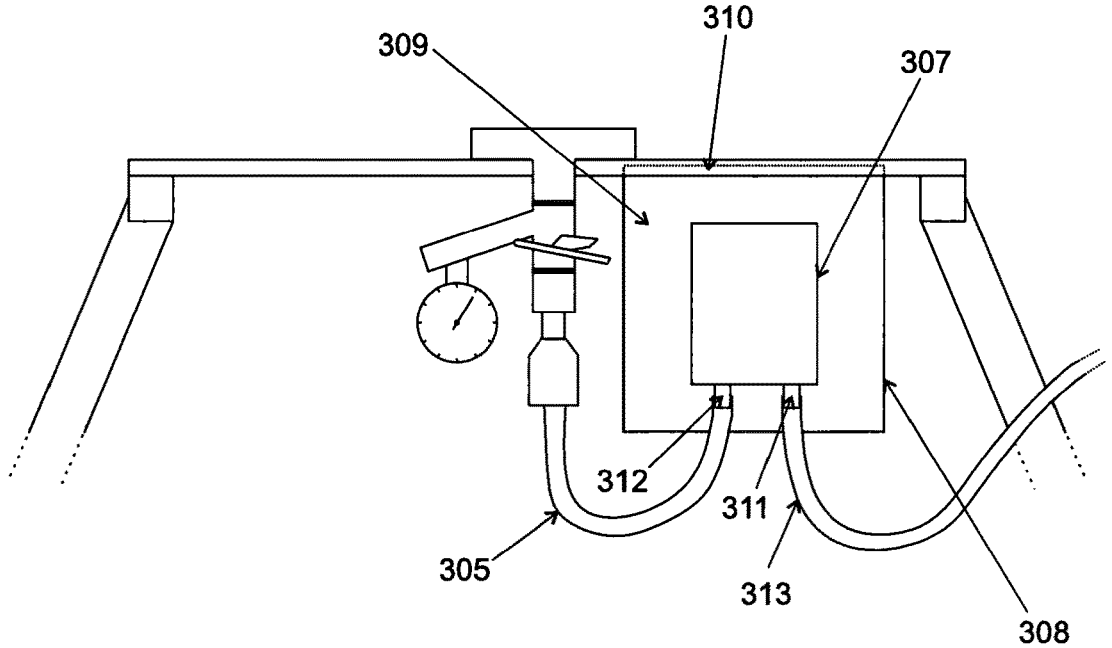
FIG. 3*b* is a semi-transparent front elevation of a second embodiment of the keg filling apparatus.

FIGS. 3*a* & 3*b*

A first embodiment of the apparatus 101 is shown in FIG. 3*a* whilst a second embodiment of the apparatus 301 is shown in FIG. 3*b*, with the apparatus in use, with the first coupling means 204 fitted by way of the first detachable member 201. It shall be understood; these examples can be readily interchanged with the second 208 and third 210 detachable members embodying the second 209 and third 211 coupling means respectively.

As described previously with reference to FIGS. 1 and 2, in the first embodiment, the apparatus 101 is configured such that said vessel 104 may be readily engaged about its valve with either the first 204, second 209 or third 211 coupling means, with the uppermost surface of said vessel 104 resting upon the substantially planar upper surface 203 of the first 201, second 208 or third 210 detachable member.

As previously discussed, the valve of the vessel is mechanically engaged with the first 204, second 209 or third 211 coupling means when the user rotates said vessel about said coupler. Once mechanically engaged, the valve and the coupling means are configured for fluid communication. The lower portion 213 of the respective coupler is then releasably mechanically linked to a manometer (indicated generally at 302) by way of a releasable mechanical linkage 303. Said releasable mechanical linkage 303 comprising a release mechanism of typical construction, adapted to provide a water tight releasable connection with the lower portion 213 of the respective coupler. Said manometer 302 is then mechanically linked by way of extended rigid pipework (indicated generally at 304) to a first pipe member 305. Said first pipe member 305 comprises elongate flexible pipework of typical construction, comprising first and second ends. Said pipework is releasably attached adjacent its first end to said extended pipework 304 by way of pipework fixings 306 of typical construction. The second end of said first pipe member 305 extends away from the apparatus 101 and is mechanically connected with a produce outlet. Said produce outlet is of typical output construction found for microbrewery vessels such as a tap.

Accordingly, in order to fill a one-way keg or vessel 104, the user first sets up the apparatus into the primed position (as discussed in FIG. 2). The user then connects the first pipe member 305 to the lower portion 213 of the respective coupler (204, 209 or 211) about its first end by way of the extended pipework 304 and manometer 302 respectively. The user then connects the second end of said first pipe member to said produce outlet. The user then opens a valve on the produce outlet allowing its liquid contents to pass along the first pipe member by way of a gravity feed. In this regard, it will be understood that the vessel containing the produce to be transferred to the keg or vessel 104 lies above the level of the keg 104 as it rests on the apparatus 101. The liquid then reaches the valve of the keg or vessel 104 and proceeds to fill the container. It will be understood that for filling of one-way kegs a minimum pressure of 2 bar as a result of the pressure required to open the mechanism within the appropriate valve.

In an alternative embodiment, the apparatus 301 may further be provided with a pump 307 for forcibly filling a one-way keg 104 when there is insufficient pressure by gravity feed.

Accordingly, the apparatus may further comprise a suspended support panel 308, said support panel 308 comprising a substantially rigid structure and defining an inner face 309 and a connective margin 310. Said support panel 308 is either fixedly connected to a side surface of the top bracket 106 (by such means as welding) or it may be releasably attached to said side surface by way of attachment members (such as screws or bolts). Said side surface is substantially transverse to the top surface 202 of the top bracket 106 and is dimensioned/configured for attachment to said support panel 308 about said connective margin 310. Upon attachment of the support panel 308 to the side surface of the top bracket 106 said inner face 309 of said support panel 308 is orientated towards an interior of the stand 102. Said support panel 308 is dimensioned such that the inner face 309 may receive said pump 307 and is further fixedly or releasably attached to said pump 307. Said pump 307 comprises a pump of typical construction. Said pump comprises a produce inlet means 311 and a pump outlet means 312.

Therefore, when a user requires further pressure in order to forcibly fill a one-way keg they may first set up the apparatus in the primed position (as discussed in FIG. 2). The user may then connect the lower portion 213 of the appropriate coupler (204, 209 or 211) to the pump outlet means 312 by way of the first pipe member 305. The user may then connect the produce inlet means 311 of said pump 307 to the produce outlet means of said microbrewery vessel by way of a second pipe member 313. Said second pipe member is of similar construction to the first pipe member 305, comprising first and second ends. Said second pipe member is releasably connected at its first end to the produce inlet means 311 and is further releasably connected at its second end to the produce outlet means. The pump 307 is therefore fluidly connected with both the microbrewery vessel by way of the second pipe member 313 and the lower portion 213 of the appropriate coupler (204, 209 or 211) embodied by the apparatus 101 dependant on the detachable member (201, 208 or 210) that is selectively employed by the user. The apparatus 101 is therefore now ready for forcible filling of a one-way keg with the assistance of said pump 307.

FIG. 4

Figure 4:
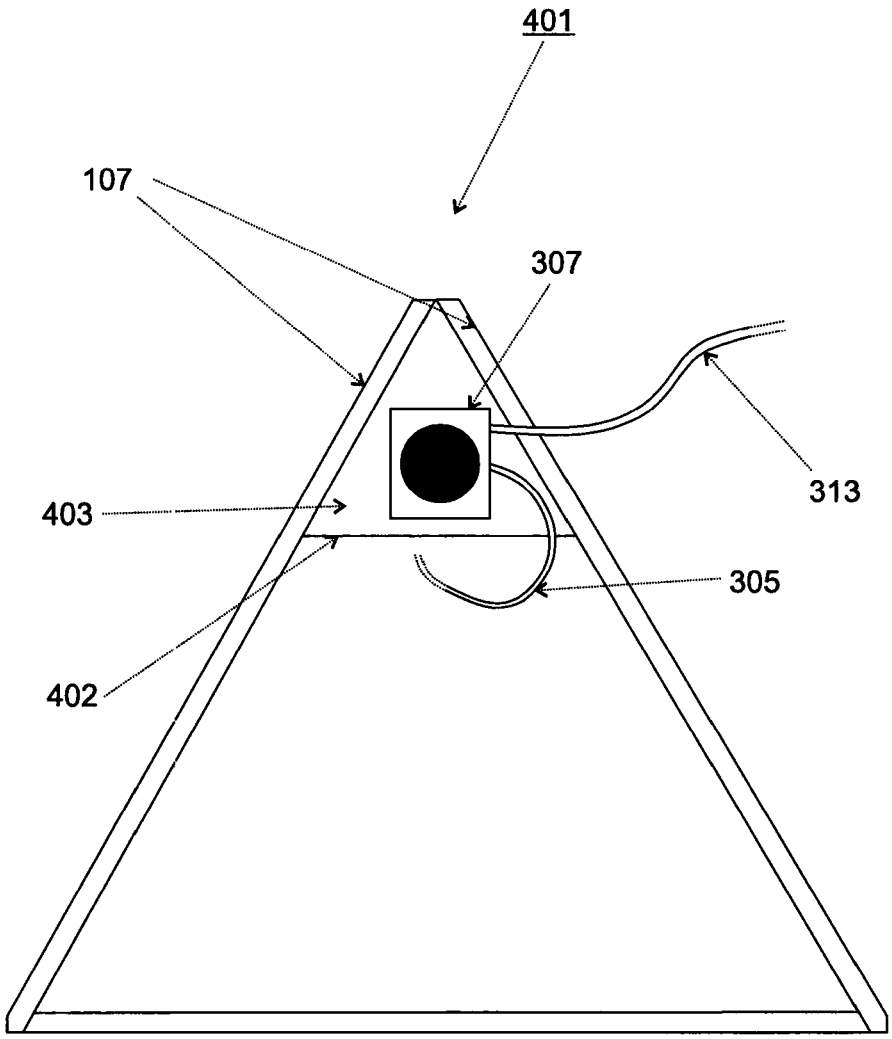
FIG. 4 is a cross-sectional elevation of a third embodiment of the apparatus, taken along line A-A of FIG. 2.

FIG. 4 represents a third embodiment of the apparatus 401.

The apparatus 401 may further be provided with a base support plate 402. Said base support plate 402 comprises a substantially rigid structure with a plate top surface 403 and is fixedly connected between two of the plurality of lateral support members 107. Said base support plate 402 may also be releasably attached to said lateral support members 107 by way of attachment members so as to provide a means of removing said base support plate in in in in a collapsible apparatus is preferred. Said attachment members may comprise threaded screws or bolts as well as hinges. Said base support plate 402 is dimensioned to receive said pump 306 upon said plate top surface 403, which may be fixedly connected or releasably attached by either welding or attachment members respectively. Said base support plate 402 therefore provides an alternative means of housing said pump 306 to the support panel 307. It shall be understood that said pump shall be utilised in the same manner as described for FIGS. 3*a* and 3*b*.

What is claimed is:

1. A keg filling apparatus comprising:

a stand means comprising a top surface;

said stand means is provided with a first detachable member and a second detachable member, wherein said first and second detachable members are interchangeable, are configured to be releasably attached to said top surface and comprises either a first coupling means or a second coupling means fixedly attached thereto respectively, for selective releasable engagement with keg valves of alternative design.

2. The keg filling apparatus of claim 1, further comprising a third detachable member, said third detachable member comprising a third coupling means, wherein said third detachable member is interchangeable with the first and second detachable members and configured to be releasably attached to the top surface of said stand means.

3. The keg filling apparatus of claim 2, wherein the top surface of said stand means comprises a plurality of top surface apertures capable of receiving attachment members for releasable attachment to any one of the first, second or third detachable members, thus facilitating mounting of any one of the first, second or third coupling means for selective compatibility with keg valves of alternative design.

4. The keg filling apparatus of claim 3, wherein the first, second and third detachable members each comprise a plurality of detachable member apertures adapted to receive said attachment members for releasable attachment to the top surface of said stand means by way of said plurality of top surface apertures.

5. The keg filling apparatus of claim 4, wherein the attachment members comprise threaded bolts or screws and an internal circumference of each said top surface aperture and said detachable member aperture is helically threaded so as to receive said threaded bolts or screws and thus releasably attach the first, second or third detachable member to the top surface of said stand means.

6. The keg filling apparatus of claim 2, wherein each of the first, second and third coupling means comprises an upper portion and a lower portion, are fixedly attached adjacent said upper portion to the first, second and third detachable members respectively and extend through said detachable members by way of a coupling aperture, such that said lower portions project substantially below a plane of said detachable member.

7. The keg filling apparatus of claim 6, wherein the stand means comprises a coupler receiving recess, dimensioned to receive the lower portion of any one of the first, second or third coupler means when the corresponding first, second or third detachable member is releasably attached to said stand means through the top surface.

8. The keg filling apparatus of claim 2, further comprising a suspended support panel, said suspended support panel comprising a substantially rigid structure with an inner face and a connective margin.

9. The keg filling apparatus of claim 8, wherein the stand means further comprises a side surface that is substantially transverse to the top surface, said side surface is attached to the suspended support panel by its connective margin so as to orientate the inner face of said suspended support panel toward an inner volume occupied by the apparatus.

10. The keg filling apparatus of claim 9, wherein the inner face of the suspended support panel is fixedly connected to pump means, said pump means is in fluid connection with a produce inlet means and the lower portion of either the first, second or third coupling means by way of a first pipe member and a second pipe member respectively.

11. The keg filling apparatus of claim 1, wherein said stand means comprises at least two stand members, said stand members comprising elongate rigid structures, each fixedly connected at a first end to opposing sides of a top bracket of said stand means.

12. The keg filling apparatus of claim 11, wherein the stand members extend generally vertically and symmetrically from said top surface of said stand means with a second end remote from the first and adapted so as to sit flush with a level surface, thus supporting the top surface of said stand means parallel to said level surface.

13. The keg filling apparatus of claim 12, wherein said stand means further comprises at least two lateral support members, said at least two lateral support members comprising substantially rigid elongate structures with first and second remote ends.

14. The keg filling apparatus of claim 13, wherein the at least two lateral support members extend between the stand members and are fixedly attached adjacent their first and second ends to said stand members at a point in between the first and second ends of said stand members.

* * * * *